US006823152B2

(12) United States Patent
Kida

(10) Patent No.: US 6,823,152 B2
(45) Date of Patent: Nov. 23, 2004

(54) IMAGE FORMING APPARATUS WITH TRANSFERRING DEVICE

(75) Inventor: Hiroshi Kida, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 70 days.

(21) Appl. No.: 10/242,421

(22) Filed: Sep. 13, 2002

(65) Prior Publication Data

US 2003/0053813 A1 Mar. 20, 2003

(30) Foreign Application Priority Data

Sep. 14, 2001 (JP) ..... 2001-278986

(51) Int. Cl.[7] ..... G03G 15/16
(52) U.S. Cl. ..... 399/101
(58) Field of Search ..... 399/49, 72, 71, 399/101, 66, 314, 313

(56) References Cited

U.S. PATENT DOCUMENTS 5,132,738 A * 7/1992 Nakamura et al. ..... 399/101
6,160,969 A 12/2000 Ishigaki et al.
6,243,544 B1 * 6/2001 Tsuneeda ..... 399/66

FOREIGN PATENT DOCUMENTS

| | | | | |
|---|---|---|---|---|
| JP | 05061369 A | * | 3/1993 | G03G/15/16 |
| JP | 08211760 A | * | 8/1996 | G03G/15/16 |
| JP | 08286494 A | * | 11/1996 | G03G/15/08 |
| JP | 2000003104 A | * | 1/2000 | G03G/15/16 |
| JP | 2000250366 A | * | 9/2000 | G03G/21/00 |

* cited by examiner

*Primary Examiner*—Robert Beatty
(74) *Attorney, Agent, or Firm*—Birch, Stewart, Kolasch & Birch, LLP

(57) ABSTRACT

A toner pattern image is formed on a surface of a photoreceptor, and an amount of toner adhering to a transferring belt is estimated in accordance with a concentration detecting signal of the toner pattern image, and a time or a voltage at which a bias having the same polarity as the toner is applied to the transferring belt is determined, so as to perform the cleaning step of the transferring belt. The amount or the concentration of the toner that actually adheres to the transferring body is detected. Further, feedback can be carried out with respect to the cleaning operation according to the detection result.

21 Claims, 5 Drawing Sheets

IMAGE FORMING APPARATUS WITH TRANSFERRING DEVICE

This nonprovisional application claims priority under 35 U.S.C. §119(a) on Patent Application No. 2001-278986 filed in Japan on Sep. 14, 2001, which is herein incorporated by reference.

1. Field of the Invention

The present invention relates to an image forming apparatus such as a printer, a copying machine, or a facsimile, based on an electric-photography system, which are provided with a transferring device, and more specifically relates to an image forming apparatus which is provided with a transferring device for transferring a developed image formed on a photoreceptor to a transferring member.

2. Background of the Invention

In an image forming apparatus such as a printer, a copying machine, or a facsimile (hereinbelow, collectively referred to as an image forming apparatus), that are based on a conventional electric-photography system, a transferring device having a charger line to perform corona discharge is used so as to transfer a developed image (hereinbelow referred to as toner image), that has been formed on a cylindrical or endless-belt-shaped photoreceptor, to a transferring member.

In such transferring device, ozone occurs upon performing the corona discharge. Thus, an ozone filter for removing the ozone is provided in the vicinity of an exhaust opening, and air containing the ozone in the device is exhausted via the ozone filter, so that the ozone is removed.

However, even though the ozone filter for removing the ozone is provided, there is limit in removing the ozone. Thus, it is often that a transferring device constituted of a transferring roller is used instead of the transferring device constituted of the charger line.

That is, there is provided the aforementioned transferring roller so as to be positioned close to or be in contact with a surface of the photoreceptor, and a bias (direct current) of a high voltage is applied to the transferring roller, so that the toner image formed on the photoreceptor is transferred to the transferring member. By using the transferring device provided with the transferring roller, it is possible not only to restrict occurrence of the ozone, but also to prevent transferring deviation that occurs upon transferring the toner image.

While, in an image forming process using the electric-photography system, quality (image quality) of a reproduced (formed) image is greatly influenced by (a) changes in an environment such as a temperature and humidity of a place where the device is provided, and (b) variation per hour and deterioration of respective members (for example, photoreceptor, exposure source, developer, transferring body, cleaning blade, and the like) that constitute an image forming portion for forming images.

Then, a test toner image (hereinbelow referred to as toner patch) is conventionally formed on the photoreceptor under a fixed condition, and an amount of an adhering toner (toner concentration) is detected, and feedback is carried out with respect to the image forming process, so as to prevent variation of the image quality, so that it is possible to constantly form images with proper quality.

U.S. Pat. No. 6,160,969 (Date of Patent Dec. 12, 2000), corresponding to Japanese Unexamined Patent Publication No. 219045/1990 (Tokukaihei 11-219045)(Publication date: Aug. 10, 1990), discloses a controlling method of (a) the transferring device having the transferring roller and (b) the image forming portion.

In the foregoing publication, as shown in FIG. 5, a transferring roller 52 is provided on a transferring section of a photoreceptor 51 so as to transfer a toner image formed on the photoreceptor 51 to paper P. Further, a latent image that has been exposed to laser light L is reproduced on the photoreceptor 51 as the toner image (toner patch) by means of a developing device 53, and the concentration of the toner patch is optically detected by an photosensor 54, so as to feedback a detection value to an electric-photography-process section for forming images. Note that, the photosensor 54 is provided between a developing portion for performing a developing step and a transferring portion for performing a transferring step.

However, according to the invention recited in the foregoing publication, there is the following case: the toner partially falls from the toner image (toner patch) to a surface of the transferring roller 52 when the toner image (toner patch) formed on the photoreceptor 51 passes through the transferring section, so that the toner adheres to the surface of the transferring roller 52.

Then, a conventional technique is arranged so that: at a timing at which the toner image formed on the photoreceptor 51 reaches the transferring roller 52, a bias having the same polarity as the toner is applied to the transferring roller so that the toner does not adhere to the transferring roller 52.

However, even though the bias having the same polarity as the toner is applied, a little toner sometimes adheres to the surface of the transferring roller 52. Note that, depending on (a) changes in an environment such as a temperature and humidity in or in the vicinity of the device, and (b) variation per hour and deterioration of a photoreceptive drum and the transferring roller 52, an amount of the toner that adheres to the surface of the transferring roller 52 also varies. Thus, in the worst case, the toner adheres to a backside of paper that passes through the transferring section, so that marking back is brought about.

It is known that: in order to prevent this defect, a bias having the same polarity as the toner is applied to the transferring roller 52, and the toner adhering to the transferring roller 52 is re-transferred to the photoreceptor 51, so as to perform cleaning continuously. Here, it is general to set a cleaning time to be a little longer than a time expected to be required in removing the toner.

In a case where the amount of the toner adhering to the transferring roller 52 is less than expected, there occurs the following case: the cleaning step is excessively performed though the toner has been cleaned from the transferring roller 52. Thus, respective members constituting the image forming section are unnecessarily used, which causes deterioration of the respective members, so that this brings about problems such as occurrence of abnormal sound, and troubles such as parts replacement caused by breakdown of parts.

If parts are designed so that lives of the parts are set to be longer than necessary so as to solve the foregoing problems, manufacturing cost of the parts is higher. As a result, this may cause price of the device and replacing cost of the parts to be higher. For example, in a case where a cylindrical photoreceptive drum is used as the photoreceptor, a photoreceptive material (photoreceptive layer) applied on a drum tube is gradually scraped, so that problems such as membranous decrease have influence on a life of the photoreceptive drum and image quality of a reproduced image.

While, in a case where the amount of the toner adhering to the transferring roller 52 is larger than expected, there occurs such problem that: the cleaning step is finished though the toner has not been cleaned from the transferring roller 52, and this causes the toner to remain on the transferring roller 52, so that there occurs marking back of the paper.

SUMMARY OF THE INVENTION

The present invention is made so as to solve the foregoing problems, and its object is to provide an image forming apparatus for performing the cleaning step with respect to the transferring body steadily without unnecessary motion.

In order to achieve the foregoing object, the image forming apparatus of the present invention includes: a transferring body for transferring a toner image on a photoreceptor to a transferring member; an photosensor for detecting at least either (a) concentration of a test toner image formed on the photoreceptor or (b) an amount of toner adhering to the transferring body; bias applying means for applying a bias having same polarity as toner so as to perform cleaning operation with respect to the transferring body to which the toner adheres; and controlling means for controlling the bias applying means so as to control the cleaning operation, that is performed with respect to the transferring body, in accordance with a detection value from the photosensor.

According to the present invention, the cleaning operation, that is performed with respect to the transferring body, is controlled, in accordance with the detection value from the photosensor for detecting at least either (a) concentration of a test toner image formed on the photoreceptor or (b) an amount of toner adhering to the transferring body.

Thus, an unnecessary cleaning operation is not performed, and it is possible to minimize a time required in cleaning, so that it is possible to efficiently re-transfer images to the photoreceptor in a short time. For example, it is possible to restrict damages given to parts such as the photoreceptor that constitute an image forming section.

Further, the amount or the concentration of the toner that actually adheres to the transferring body is detected, so that it is possible to grasp the amount of the toner without fail. Further, feedback can be efficiently carried out with respect to the cleaning operation according to the detection result, so that it is possible to minimize a time required in completing the cleaning of the transferring body.

For a fuller understanding of the nature and advantages of the invention, reference should be made to the ensuing detailed description taken in conjunction with the accompanying drawings.

BRIEF DESCRIPTION OF THE DRAWINGS

FIG. 2(*b*) is a drawing showing a relationship between a cleaning time and bias adjustment so as to illustrate the first embodiment of the present invention.

FIG. 3(*b*) is a drawing showing that an amount of toner re-transferred to a photoreceptor is decreased by a cleaning bias.

FIG. 4(*b*) is a drawing for illustrating a difference between a concentration detecting level of the toner that has not reached a transferring belt and a concentration detecting level of the toner that has passed through the transferring belt.

DESCRIPTION OF THE EMBODIMENTS

Basic Embodiment of the Present Invention

Figure 1:
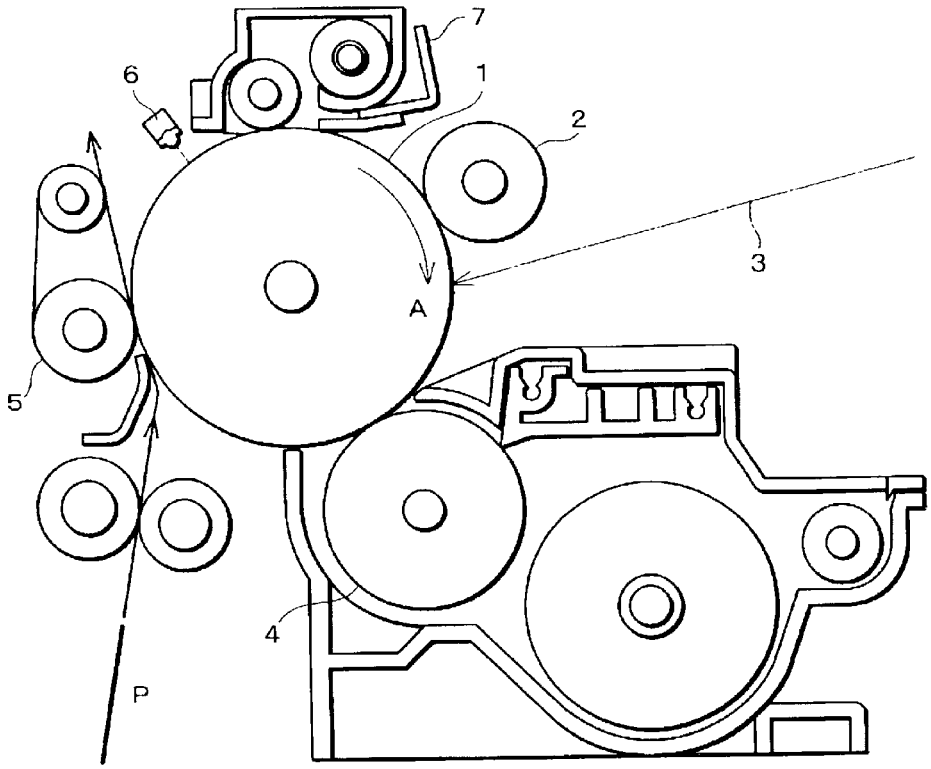
FIG. 1 is a sectional view of an image forming apparatus according to a basic embodiment of the present invention.

FIG. 1 is a sectional view of a transferring device according to an embodiment of the present invention. In the periphery of a photoreceptor 1, there are provided a charging device 2, a laser light path (laser light) 3, a developing device 4, a transferring belt 5 used as a transferring body, a photosensor 6, and a cleaning device 7 so as to surround the photoreceptor in this order in a clockwise direction, and the photoreceptor 1 rotates in an A direction (clockwise direction). Note that, the transferring body is not limited to this, but may be a transferring belt for example.

It is typical that laser light 3 having been modulated in accordance with data of a recorded image forms an electrostatic latent image by sequentially exposing a charged surface of the photoreceptor 1 by each line in a main scanning direction. Next, the developing device 4 reproduces the electrostatic latent image as a toner image, and the toner image reproduced on the photoreceptor 1 is transferred to paper at the transferring belt 5, so that the toner image transferred to the paper by a fixing device (not shown) is visualized as a permanent image.

Next, description is given on how an image forming section of an electric-photograph system is controlled (hereinbelow referred to as process control).

Basically, a pattern image (toner image) T having a specific shape is formed on the photoreceptor 1 by using the toner, and concentration (reflection) of the pattern image is detected by means of the photosensor 6. First, the surface of the photoreceptor 1, that has been uniformly (evenly) charged at a predetermined level (reference level) by the charging device 2, is exposed by the modulated laser light 3 that forms a specific pattern image.

A portion (electrostatic latent image), that has been exposed by the laser light 3, is exposed by the developing device 4, so that the portion is visualized as the toner pattern image. Next, the toner pattern image reaches an area, where detection is performed by the photosensor 6, after being subjected to a transferring step. Here, the toner concentration of the toner pattern image T is detected by the photosensor 6. In accordance with the detection result, the image forming section is subjected to the process control.

Note that, the process control means to adjust outputs such as a charging level, an exposing level, a developing bias, or a transferring level. These outputs are adjusted, so that influence is exerted with respect to a reproduced (formed) image. That is, this means such step that: the toner pattern image is formed on the surface of the photoreceptor 1 under a predetermined condition on trial, and the amount of the adhering toner is detected by the photosensor 6, so as to adjust an image expression formed by controlling at least one part of the image forming section (electric-photographic process).

Further, in accordance with data that has been detected by the photosensor 6, it is also possible to perform image correction (concentration correction and the like) with respect to an image data (electric-photographic data), that has been reproduced by the electric-photographic process, based on an image processing.

Note that, when the toner pattern image T passes between the photoreceptor 1 and the transferring belt 5, a bias having the same polarity as the toner is applied to the transferring belt 5 so that the toner does not adhere to the transferring belt 5 to some extent.

However, as described above, the toner adheres to the surface of the transferring belt 5 to some extent due to changes of its environment and conditions. Then, in accordance with an output obtained when the photosensor 6 disposed on the downstream side with respect to the transferring belt 5 detects the toner pattern image, how much toner adheres to the surface of the transferring belt 5 is predicted, so that control of the cleaning step is performed with respect to the transferring belt 5 after performing the process control step (that is, the step such that: the toner pattern image is formed on the surface of the photoreceptor 1 under a predetermined condition on trial, and the amount of the adhering toner is detected by the photosensor 6, so as to adjust an image expression formed by controlling at least one part of the electric-photographic process).

First Embodiment of the Present Invention

In the present embodiment, the amount of the toner adhering to the transferring belt 5 is estimated in accordance with concentration detecting signal (output from the photosensor 6) of the toner pattern image T that has been detected upon performing the process control, and a time or a voltage value at which a bias having the same polarity as the toner is applied to the transferring belt 5 is determined, so as to carry out the cleaning process with respect to the transferring belt 5.

Note that, the amount of the toner adhering to the transferring belt 5 is estimated as follows: The electric-photographic process is operated under a predetermined condition so as to grasp the amount of the adhering toner of the toner pattern image T in advance. On the downstream side with respect to a passing point between the photoreceptor 1 and the transferring belt 5, a level difference between the grasped amount and the amount actually detected by the photosensor 6 is obtained so as to calculate the amount of the toner adhering to the surface of the transferring belt 5.

This is expressed as follows.

Predicted Level−Detected Level=Adhering Toner Amount

Then, in accordance with the amount of the adhering toner at this time, an applying condition of a cleaning bias (bias having the same polarity as the toner) applied to the transferring belt 5 is determined. For example, in a case where it is supposed that the amount of the adhering toner is large, a bias applying level is set to be high. In a case where it is supposed that the amount of the adhering toner is small, a bias applying level is set to be low.

Note that, it is possible to set the bias applying level not only based on whether the amount of the adhering toner is large or small, but also by switching the bias applying levels in plurality corresponding to the amount of the adhering toner (level) actually calculated from the output of the photosensor 6.

Further, also the cleaning bias applied to the transferring belt 5 controls the cleaning step by adjusting the bias voltage level and by adjusting the bias applying time.

Figure 2:
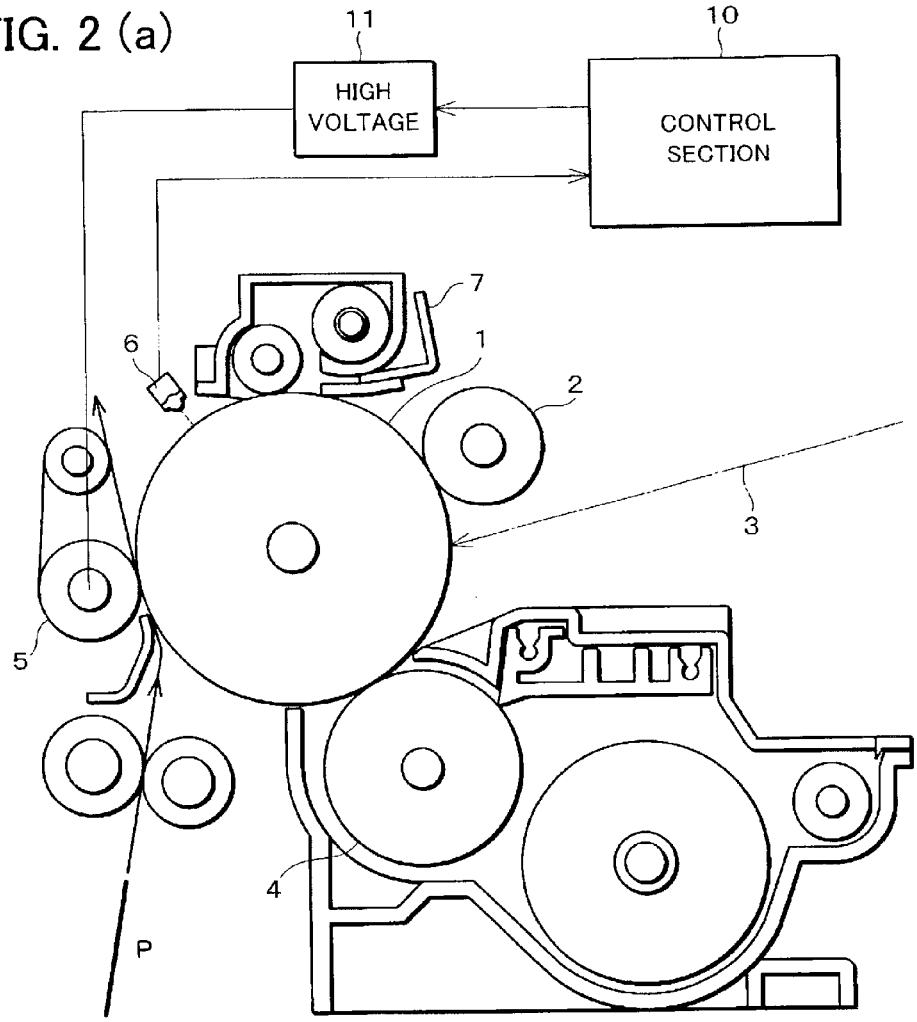
FIG. 2(*a*) is a drawing showing a relationship between a sectional surface and a control system of the image forming apparatus so as to illustrate a first embodiment of the present invention.
Figure 2:
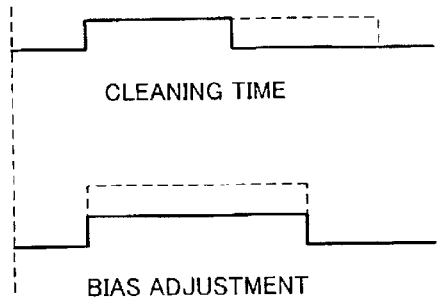

FIG. 2(*a*) is a drawing showing a relationship between a sectional surface and a control system of the image forming section so as to illustrate the present embodiment. Further, FIG. 2(*b*) is a drawing showing a relationship between the cleaning time and the bias adjustment.

In FIG. 2(*a*), a detecting signal from the photosensor 6 is inputted to a control section 10 via an interface, and in accordance with a detected signal level, the amount of the toner adhering to the transferring belt 5 is estimated (the estimation is performed by calculation, or by referring to a table, and the like). Then, according to the estimation result, the control section 10 instructs a high voltage (high voltage unit) 11, that switches the transferring bias or the cleaning bias so as to apply the switched bias to the transferring belt 5, to apply the bias while adjusting the applying condition of the cleaning bias.

In a time chart shown in FIG. 2(*b*), a continuous line shows an applying condition of the minimum level. This shows that: with increase in the amount of the adhering toner, the applying condition increases in incremental step or in a linear manner. That is, the upper timing chart shows increase/decrease in the cleaning time, and the lower timing chart shows increase/decrease in the applied voltage of the cleaning bias.

Second Embodiment of the Present Invention

Figure 3:
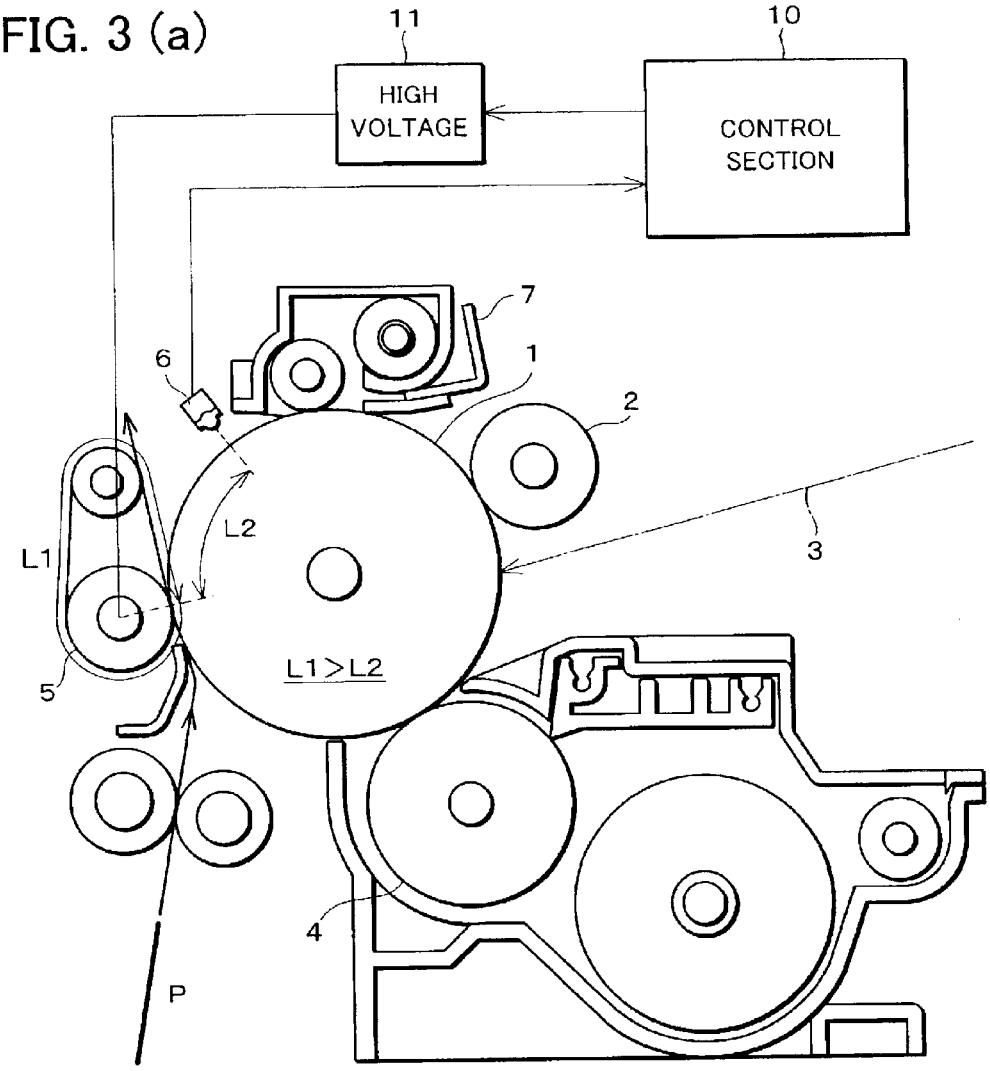
FIG. 3(*a*) is a drawing showing a relationship between the sectional surface and the control system of the image forming apparatus so as to illustrate a second embodiment of the present invention.
Figure 3:
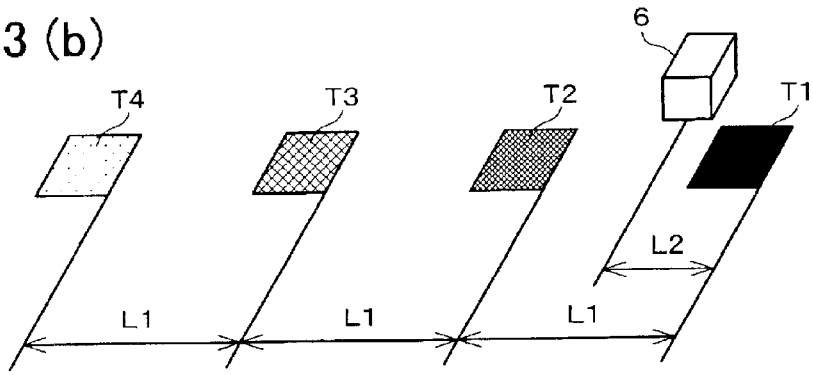

FIG. 3(*a*) is a drawing showing a relationship between the sectional surface and the control system of the image forming section so as to illustrate the present embodiment. Further, FIG. 3(*b*) is a drawing showing that an amount of toner re-transferred to a photoreceptor is decreased by the cleaning bias.

In FIG. 3(*a*), while applying a bias (cleaning bias) having the same polarity as the toner to the transferring belt 5 with a part of the toner pattern image T adhering to the surface thereof, changes in the amount of the adhering toner that is transferred to the photoreceptor 1 are read by means of the photosensor 6.

Then, when the amount of the adhering toner is not more than a predetermined level while monitoring gradual decrease in the amount of the adhering toner, the cleaning step is stopped.

The cleaning step of the transferring belt 5, that is, applying the bias of the same polarity as the toner to the transferring belt 5 is basically performed as in the first embodiment.

In FIG. 3(*a*), a contact point between the transferring body and the photoreceptor to a point on which light is irradiated by the photosensor (L2) is shorter than the circumference (L1) of the transferring body.

FIG. 3(*b*) shows that: according to the concentration (amount of adhering toner) of the toner pattern image detected by the photosensor 6, the cleaning bias is applied to the transferring belt 5, and an amount of the toner that is re-transferred from the surface of the transferring belt 5 to the surface of the photoreceptor 1 varies.

First, the photosensor 6 shows that the amount of the toner adhering to (re-transferred to) the surface of the photoreceptor 1 gradually decreases (gradually fades away) from the right side to the left side of the drawing. This means that the amount of the re-transferred toner gradually decreases, that is, the amount of the toner adhering to the surface of the transferring belt 5 decreases (the surface is cleaned).

When the photosensor 6 detects the first toner pattern image T1, the cleaning step of the transferring belt 5 (application of the bias having the same polarity as the toner) is performed in accordance with the detection result. Then, the amount of the toner adhering to the surface of the photoreceptor 1 at this time (second toner pattern image T2) is detected again by the photosensor 6. In accordance with the detection result, the cleaning step of the transferring belt 5 (application of the bias having the same polarity as the toner) is performed again. Thereafter, the cleaning step is repeated, so that toner pattern images T3 and T4 gradually fade away.

This means that the amount of the toner adhering to the surface of the transferring belt 5 decreases. Then, the foregoing operation is repeated until the photosensor 6 confirms that the concentration of the toner pattern image Tn is not more than a predetermined concentration, by means of its output. That is, the toner re-transferred to the surface of the photoreceptor 1 becomes less, which shows that the amount of the toner adhering to the surface of the transferring belt 5 becomes less.

Further, as shown in FIG. 3(*a*), the photosensor 6 is disposed on the downstream side, in a rotating direction of the photoreceptor 1, with respect to a point where the transferring belt 5 is in contact with the surface of the photoreceptor 1 (transferring area).

This is based on the following reason.

That is, a part of the toner pattern image T that has adhered to the transferring belt 5 is in contact with the photoreceptor 1 repeatedly at a constant cycle (peripheral length of the transferring belt 5) in each rotation of the transferring belt 5. Thus, a part of the toner pattern image T that cyclically appears on the photoreceptor 1 is repeatedly detected as quickly as possible by means of the photosensor 6, and feedback is carried out so that the cleaning bias applied to the transferring belt 5 at once is controlled in accordance with the detection result. As a result, it is possible to minimize a time required in completing cleaning of the transferring belt 5.

Third Embodiment of the Present Invention

Figure 4:
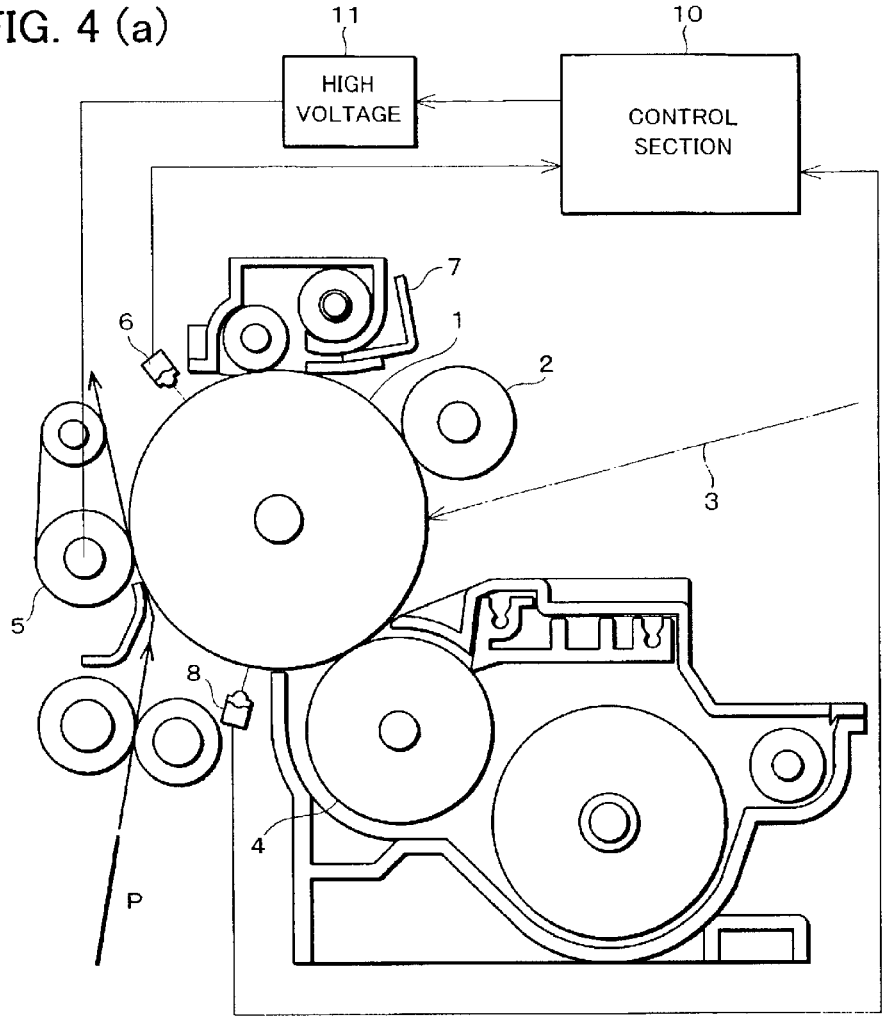
FIG. 4(*a*) is a drawing showing a relationship between the sectional surface and the control system of the image forming apparatus so as to illustrate a third embodiment of the present invention.
Figure 4:
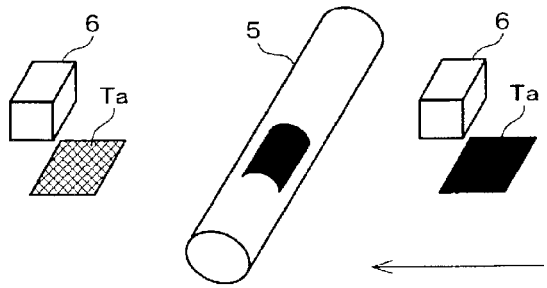
Figure 5:
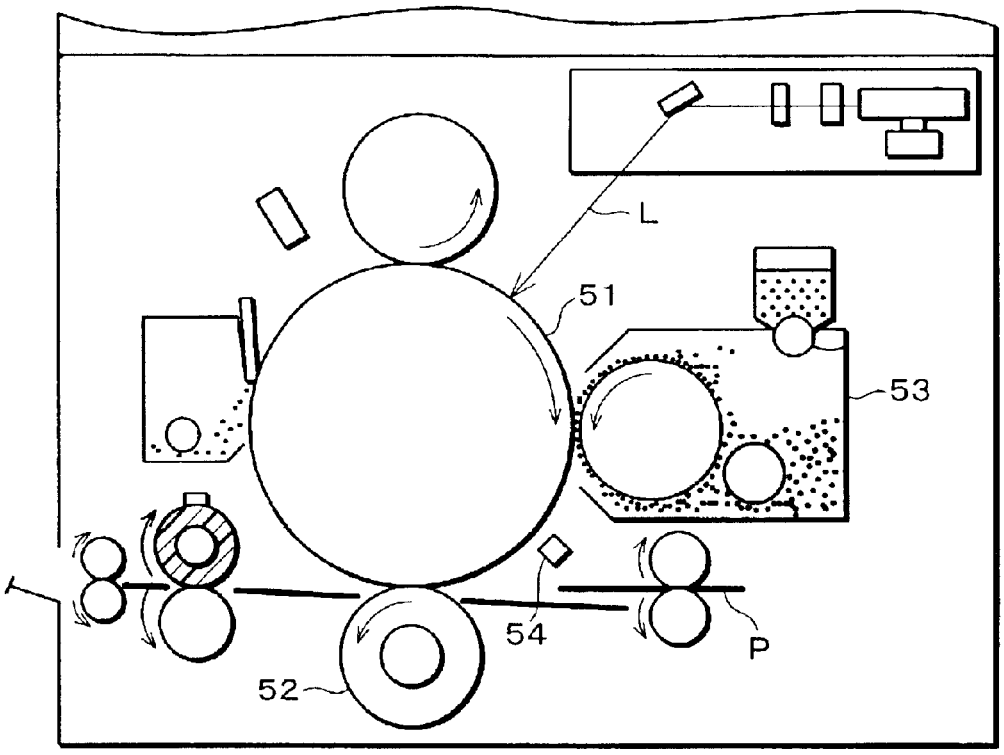
FIG. 5 (PRIOR ART)
FIG. 5 is an entire cross sectional view of a conventional image forming apparatus.

FIG. 4(*a*) is a drawing showing a relationship between the sectional surface and the control system of the image forming section so as to illustrate the present embodiment. Further, FIG. 4(*b*) is a drawing for illustrating a difference between a concentration detecting level of the toner that has not reached a transferring belt 5 and a concentration detecting level of the toner that has passed away the transferring belt 5.

In the present embodiment, a second photosensor 8 is provided opposite to the photosensor 6 disposed on the downstream side, in a rotating direction of the photoreceptor, with respect to the transferring belt 5 (upstream side of the transferring belt 5). The second photosensor 8 detects the concentration of the toner pattern image T, that has actually formed on the photoreceptor 1, by a time when the toner pattern image T reaches the transferring belt 5.

Then, in accordance with the difference (difference in the detecting level) between the concentration detecting level of the toner that has not reached a transferring belt 5 and the concentration detecting level of the toner that has passed away the transferring belt 5, the amount of the toner that would adhere to the transferring belt 5 is estimated. Then, a time or a voltage at which the cleaning bias having the same polarity as the toner is applied to the transferring belt 5 is determined, so as to carry out the cleaning step of the transferring belt 5.

After estimating the amount of the toner that would adhere to the transferring belt 5 in accordance with a part of the toner pattern image T adhering to the surface of the photoreceptor 1, the cleaning bias having the same polarity as the toner is applied to the transferring belt 5 basically in the same manner as in the first and second embodiments.

In the present embodiment, a toner pattern image Ta is formed on the surface of the photoreceptor 1, and the toner concentration of a toner pattern image Tb that has passed between the transferring belt 5 and the photoreceptor 1 is detected, so as to carry out the process control. Thereafter, feedback control is performed with respect to the cleaning step of the transferring belt 5 in accordance with a relationship between the toner pattern images Ta and Tb.

Note that, in the foregoing embodiments, the first through third embodiments are separately described. However, by combining the respective embodiments (at least any two of them) or all the embodiments together, it is possible to carry out the cleaning step of the transferring belt 5.

Further, in the foregoing embodiments, the apparatus using the cylindrical photoreceptive drum as the photoreceptor 1 is described. However, the present invention is not limited to this, but a photoreceptive belt in an endless form may be used for example.

Further, in the foregoing embodiments, the transferring belt 5 or the transferring roller as a transferring body is described. The transferring body is not limited to this, but this can be applied to a transferring mechanism using a transferring brush or other system.

As described above, in the image forming apparatus of the present invention, controlling means may change the time or the voltage, at which the bias is applied to the bias applying means, so as to control the cleaning operation.

Further, in the image forming apparatus of the present invention, the photosensor may be provided on the downstream side, in a moving direction of the photoreceptor, with respect to the transferring body.

Further, in the image forming apparatus of the present invention, the photosensor may be provided on the downstream side with respect to the transferring body so that a distance from (a) a contact point between the transferring body and the photoreceptor to (b) a point on which light is irradiated by the photosensor is shorter than a peripheral length of the transferring body.

Further, in the image forming apparatus of the present invention, the controlling means may further control repetition of (a) forming the test toner image and (b) performing the cleaning operation, until the test toner image becomes not more than a predetermined value.

Further, the image forming apparatus of the present invention may be arranged so that: the image forming apparatus further includes a second photosensor, disposed on the upstream side with respect to the photoreceptor, that detects at least either (a) concentration of the toner image formed on the photoreceptor or (b) an amount of toner adhering to the toner image, wherein the controlling means controls the bias applying means so as to control the cleaning operation, that is performed with respect to the transferring body, in accordance with a detection value from the second photosensor.

Further, in the image forming apparatus of the present invention, the transferring body may be a transferring belt.

Further, in the image forming apparatus of the present invention, the transferring body may be a transferring roller.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

a transferring body for transferring a toner image on a photoreceptor to a transferring member;

a photosensor for detecting at least either concentration of a test toner image formed on the photoreceptor or an amount of toner adhering to the test toner image, the photosensor is provided on a downstream side in a moving direction of the photoreceptor with respect to the transferring body so that a distance from a contact point between the transferring body and the photoreceptor to a point on which light is irradiated by the photosensor is shorter that a peripheral length of the transferring body;

bias applying means for applying a bias having same polarity as toner so as to perform a cleaning operation with respect to the transferring body to which the toner adheres; and controlling means for controlling the bias applying means so as to control the cleaning operation, that is performed with respect to the transferring body, in accordance with a detection value from the photosensor.

2. The image forming apparatus as set forth in claim 1, wherein the controlling means changes a time or a voltage, at which the bias is applied to the bias applying means, so as to control the cleaning operation.

3. The image forming apparatus as set forth in claim 1, wherein the controlling means further controls repetition of forming the test toner image and performing the cleaning operation, until the toner test image becomes not more than a predetermined value.

4. The image forming apparatus as set forth in claim 2, wherein the controlling means further controls repetition of forming the test toner image and performing the cleaning operation, until the toner test image becomes not more than a predetermined value.

5. The image forming apparatus as set forth in claim 1, wherein the transferring body is a transferring belt.

6. The image forming apparatus as set forth in claim 1, wherein the transferring body is a transferring roller.

7. An image forming apparatus comprising:

a transferring body for transferring a toner image on a photoreceptor to a transferring member;

a photosensor for detecting at least either concentration of a test toner image formed on the photoreceptor or an amount of toner adhering to the test toner image bias applying means for applying a bias having same polarity as toner so as to perform cleaning operation with respect to the transferring body and to which the toner adheres;

controlling means for controlling the bias applying means so as to control the cleaning operation, that is performed with respect to the transferring body, in accordance with a detection value from the photosensor, further comprising a second photosensor, provided on an upstream side in the moving direction of the photoreceptor, that detects at least either concentration of the test toner image formed on the photoreceptor or an amount of the toner adhering to the test toner image, wherein the controlling means controls the bias applying means so as to control the cleaning operation, that is performed with respect to the transferring body, in accordance with a detection value from the second photosensor.

8. The image forming apparatus as set forth in claim 7, wherein the controlling means changes a time or a voltage, at which the bias is applied to the bias applying means so as to control the cleaning operation.

9. The image forming apparatus as set forth in claim 7, wherein the photosensor is provided on a downstream side, in a moving direction of the photoreceptor, with respect to the transferring body.

10. The image forming apparatus as set forth in claim 8, wherein the photosensor is provided on a downstream side, in a moving direction of the photoreceptor, with respect to the transferring body.

11. The image forming apparatus as set forth in claim 9, wherein the photosensor is provided on the downstream side with respect to the transferring body so that a distance from a contact point between the transferring body and the photoreceptor to a point on which light is irradiated by the photosensor is shorter is shorter than a circumference of the transferring body.

12. The image forming apparatus as set forth in claim 10, wherein the photosensor is provided on the downstream side with respect to the transferring body so that a distance from a contact point between the transferring body and the photoreceptor to a point on which light is irradiated by the photosensor is shorter than a circumference of the transferring body.

13. The image forming apparatus as set forth in claim 7, wherein the controlling means further controls repetition of forming the test toner image and performing the cleaning operation, until the toner test image becomes not more than a predetermined value.

14. The image forming apparatus as set forth in claim 8, wherein the controlling means further controls repetition of forming the test toner image and performing the cleaning operation, until the toner test image becomes not more than a predetermined value.

15. The image forming apparatus as set forth in claim 9, wherein the controlling means further controls repetition of forming the test toner image and performing the cleaning operation, until the toner test image becomes not more than a predetermined value.

16. The image forming apparatus as set forth in claim 10, wherein the controlling means further controls repetition of forming the test toner image and performing the cleaning operation, until the toner test image becomes not more than a predetermined value.

17. The image forming apparatus as set forth in claim 11, wherein the controlling means further controls repetition of forming the test toner image and performing the cleaning operation, until the toner test image becomes not more than a predetermined value.

18. The image forming apparatus as set forth in claim 12, wherein the controlling means further controls repetition of forming the test toner image and performing the cleaning operation, until the toner test image becomes not more than a predetermined value.

19. The image forming apparatus as set forth in claim 7, wherein the transferring body is a transferring belt.

20. The image forming apparatus as set forth in claim 7, wherein the transferring body is a transferring roller.

21. An image forming apparatus, comprising:

a transferring body for transferring a toner image on a photoreceptor to a transferring member;

a bias applying means for applying a bias having same polarity as toner so as to perform cleaning operation with respect to the transferring body to which the toner adheres;

a first sensor for detecting at least either concentration of the toner image or an amount of toner adhering to the photoreceptor after the toner image formed on the photoreceptor passes the transferring body;

a second sensor for detecting at least concentration of the toner image or an amount of toner adhering to the photoreceptor before the toner image formed on the photoreceptor passes the transferring body; and controlling means for controlling the bias applying means so as to control the cleaning operation, that is performed with respect to the transferring body, in accordance with the detection values from the first sensor and the second sensor.

* * * * *